US006764022B2

(12) United States Patent
Mohr et al.

(10) Patent No.: US 6,764,022 B2
(45) Date of Patent: Jul. 20, 2004

(54) DOUBLE SLEEPER FOR GETRAC A3 FIXED TRACK

(75) Inventors: Winfried Mohr, Neumarkt (DE); Gerhard Berns, Weissenburg (DE); Gundolf Spitzner, Allersberg (DE)

(73) Assignee: Pfleiderer Infrastrukturtechnik GmbH & Co. KG, Neumarkt (DE)

( * ) Notice: Subject to any disclaimer, the term of this patent is extended or adjusted under 35 U.S.C. 154(b) by 108 days.

(21) Appl. No.: 10/210,773

(22) Filed: Aug. 1, 2002

(65) Prior Publication Data

US 2003/0042322 A1 Mar. 6, 2003

(30) Foreign Application Priority Data

Sep. 4, 2001 (DE) ..... 101 43 298

(51) Int. Cl.[7] ..... E01B 21/04
(52) U.S. Cl. ..... 238/35
(58) Field of Search ..... 238/29, 31, 35

(56) References Cited

FOREIGN PATENT DOCUMENTS

| | | | | |
|---|---|---|---|---|
| DE | 44 09 653 | | 9/1995 | |
| DE | 4409653 | * | 9/1995 | ..... E01B/1/00 |
| DE | 44 21 985 | | 1/1996 | |
| DE | 199 57 223 | | 6/2001 | |

* cited by examiner

*Primary Examiner*—S. Joseph Morano
*Assistant Examiner*—Robert J. McCarry, Jr.
(74) *Attorney, Agent, or Firm*—Jordan and Hamburg LLP

(57) ABSTRACT

A railroad tie having a compact design for a fixed track with an overlay of asphalt of the Getrac A3 construction with a dowel stone which is inserted in a recess and which protrudes downward into engagement with a cavity pocket of the asphalt track. The railroad tie is constructed as a double railroad tie which forms only a narrow gap with the adjacent railroad tie in order to make radial laying (curve) possible and which is provided in the region of the dowel stone on the underside with lateral constrictions so that the cavity pockets can be filled subsequently.

20 Claims, 1 Drawing Sheet

DOUBLE SLEEPER FOR GETRAC A3 FIXED TRACK

FIELD OF THE INVENTION

The present invention relates to a railroad tie having a compact design for a fixed track with an overlay of asphalt of the Getrac construction with a dowel stone which is inserted in a recess on the underside of the railroad tie and which protrudes downward into engagement with a cavity pocket of the asphalt track.

BACKGROUND OF THE INVENTION

In the case of railroad ties having a compact design for fixed tracks of the Getrac construction, a very high surface pressure results when normal railroad ties are used. As a consequence, over time, the railroad tie is pressed more and more into the asphalt, so that the height adjustment of the cast track is lost. In the case of the Getrac system, the cavity pocket of the asphalt track is filled after the railroad ties or a premanufactured track grid are aligned, in order to anchor the dowel stone, since, after all, the cavity pocket must be constructed larger initially in order to be able to compensate for manufacturing and laying tolerances. This, however, presupposes, in turn, that the cavity pocket protrudes somewhat laterally beyond the railroad tie, as clean casting can otherwise not take place.

SUMMARY OF THE INVENTION

It is therefore an object of the invention to configure a railroad tie having a compact design for a fixed track with an overlay of asphalt of the Getrac construction in which less surface pressure is present and nevertheless, it is possible to fill the cavity pockets of the asphalt track after the railroad ties are aligned.

Pursuant to the invention, this objective is achieved by a railroad tie having a compact design and which is formed as a double railroad tie between which railroad tie and an adjacent railroad tie, there is only a small gap which enables a curve to be laid and which, in the region of the dowel stone on the underside, is provided with lateral constrictions for subsequently filling the cavity pockets.

Instead of the normal, wide railroad ties having a compact design previously used, double railroad ties are employed pursuant to the invention, the width of which is such that they, in each case, form only a narrow gap with the neighboring railroad tie. In this manner, the surface pressure evidently becomes very much less and the danger of sinkage into the asphalt does not arise. Due to the lateral constrictions in the region of the dowel stone, which are unusual in the case of double sleepers laid on track ballast, the cavity pockets of the asphalt track, which are in the region of these constrictions, are exposed at least at the outer edge so that, in spite of the almost complete coverage of the asphalt track by the double railroad ties, the cavity pockets of the asphalt track can still be filled subsequently and as a result, the dowel stones engaging therein can be anchored.

Moreover, the novel use of the special double railroad ties also has the advantage that, due to the great weight of the railroad ties, the load on the dowel stone in the transverse and longitudinal directions is less since the weight of the railroad ties alone largely absorbs the direct transfer of forces as a carriage passes over the railroad ties.

Moreover, it is also within the scope of the invention to provide the novel double railroad tie in the region of the pocket accommodating the dowel stone with a cavity having a low height which extends over the entire width and also over a greater length than does the recess for the dowel stone. This cavity prevents the railroad tie being supported precisely in the middle and, as a result, also the danger of breakage. Moreover, due to this gap, air can escape through this gap while the cavity pocket of the asphalt track is being filled so that this filling can take place more quickly and more uniformly.

Further advantages, distinguishing features and details of the intervention arise out of the following description of an example and the accompanying drawings.

DETAILED DESCRIPTION OF THE PREFERRED EMBODIMENTS

Figure 1:
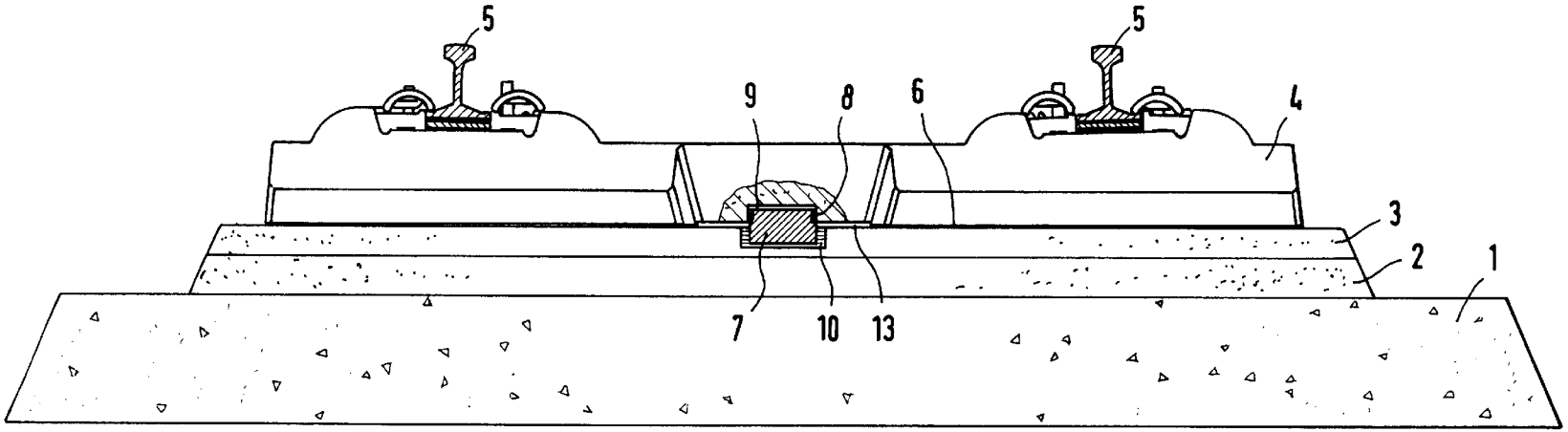
FIG. 1 shows a section through a fixed track with a partially broken open railroad tie of compact design, constructed as a double railroad tie.
Figure 3:
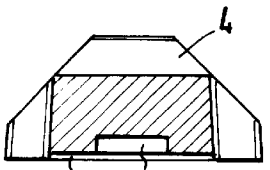
FIG. 3 shows a section through the double railroad tie along the line III—III of FIG. 2.

The construction of a fixed track with an asphalt overlay of the Getrac A3 construction can be seen best in FIG. 1 which shows a lower supporting layer 1 on which two differently constructed asphalt layers 2 and 3 are applied. For fastening rails 5, a non-woven fabric 6 is arranged between the upper asphalt layer 3 and the railroad tie 4 having a compact design in accordance with the invention. The railroad tie is formed as a double railroad tie so that there is only a small gap between it and the neighboring railroad tie. As is customary in the case of fixed tracks of the Getrac A3 construction, the double railroad tie is provided with a dowel stone 7 which is held with the help of an elastic ring bearing 8 in a recess 9 on the underside of the railroad tie. This dowel stone 7 engages a larger cavity pocket 10 of the asphalt layer 3, the exact position occupied by this cavity pocket resulting only during the adjustment of the track grid. For this reason, the cavity pocket 10 is also constructed larger.

Figure 2:
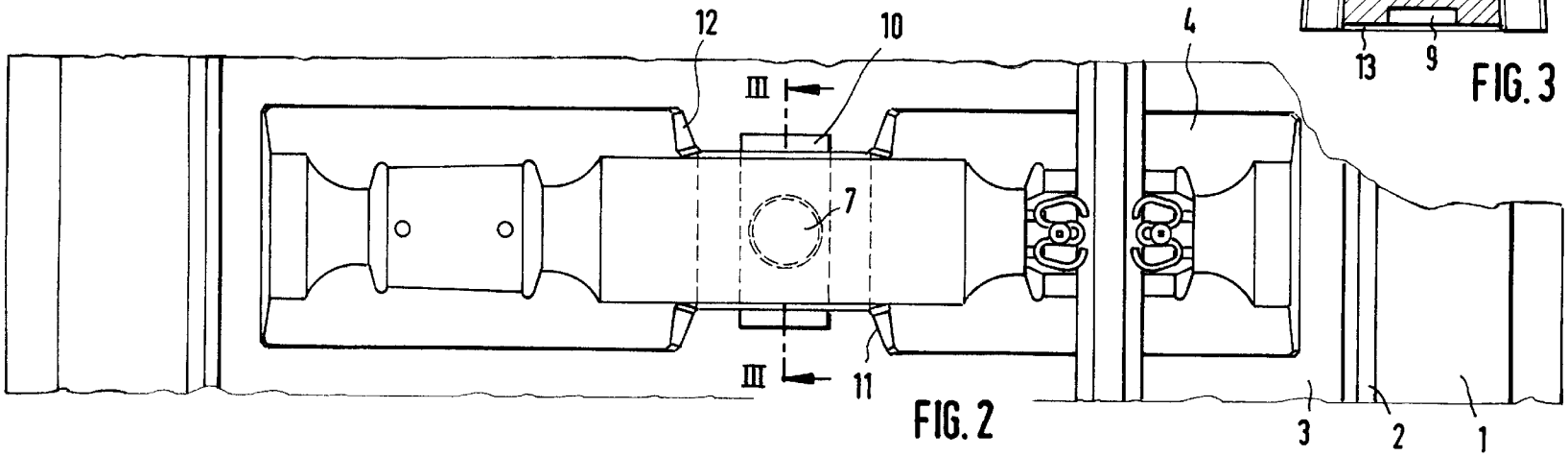
FIG. 2 shows a plan view of the track of FIG. 1.

After the adjustment, the cavity pocket 10 is once again filled with asphalt. For this purpose, the cavity pocket 10 must, of course, be open at the top. In accordance with the invention, this is achieved because the double railroad tie 4 is provided in the region of the dowel stone 7 with lateral constrictions 11 and 12, as a result of which the cavity pocket 10 is open at its upper ends, i.e., the lateral constrictions 11,12 cause a portion of the railroad tie 4 to have a smaller width than the width of the cavity pocket 10 so that the upper ends of the cavity pocket 10 (one on each side of the railroad tie 4) are open (as shown in FIG. 2). In view of the presence of the lateral constrictions 11 and 12, the subsequent filling of the cavity pocket 10, after the adjustment of the railroad ties 4, is assured in spite of the otherwise almost complete coverage of the asphalt track 3. As can clearly be seen in FIG. 2, the lateral constrictions 11 and 12 result in a narrower width in the central portion of the body of the double railroad tie 4 than at portions at which the rails 5 are supported whereby the upper ends of the cavity pocket 10 are not covered by the narrower width central portion of the double railroad tie 4 and are exposed. Furthermore, each lateral constriction 11,12 has two portions, each portion extending from a respective lateral side of the railroad tie 4 so that there are two lateral constriction portions adjacent the right rail-supporting portion of the rail 4 on opposite sides of the central portion and two lateral constriction portion adjacent the left rail-supporting portion on opposite sides of the central portion (see FIG. 2). As such, the portions of lateral constriction 11 are opposite the portions of lateral constriction 12.

In the region of the lateral constrictions 11 and 12, the double railroad tie 4 is provided on the underside with a continuous depression, gap or cavity 13 having a low height which extends over the entire width. On the one hand, this prevents the railroad tie being supported in the center and thus prevents the danger of breakage. On the other hand, while the cavity pockets 10 are being filled with asphalt, air can escape through the depression, gap or cavity 13, which is open towards of the side in the region of the lateral constrictions 11 and 12, so that the filling of the cavity pocket 10 with asphalt can take place more rapidly and more uniformly without blow-hole sites.

What is claimed is:

1. A railroad tie having a compact design for a fixed track with an overlay of asphalt of the Getrac A3 construction, comprising:

a body having first and second rail-supporting portions and a central portion between said first and second rail-supporting portions, said first and second rail-supporting portions having a width, said central portion having a recess on an underside;

a dowel stone arranged in said recess on the underside of said central portion of said body and adapted to engage a cavity pocket of the asphalt track, said body including lateral constrictions arranged in a region of said dowel stone to provide said central portion with a smaller width than the width of said first and second rail-supporting portions such that ends of the cavity pockets are uncovered.

2. The railroad tie of claim 1, further comprising an elastic ring bearing for holding said dowel stone in said recess on the underside of said central portion of said body.

3. The railroad tie of claim 1, wherein said central portion of said body includes a cavity on the underside having a low height and which is continuous over the width of said central portion.

4. The railroad tie of claim 1, wherein said central portion of said body includes a cavity on the underside which extends over a width of said central portion and over a greater length of said central portion than said dowel stone and prevents said central portion from being supported directly by the asphalt track.

5. The railroad tie of claim 1, further comprising a fabric substrate arranged only below said first and second rail-supporting portions and not below said central portion of said body.

6. The railroad tie of claim 1, wherein said lateral constrictions include first and second lateral constriction portions adjacent said first rail-supporting portion and arranged on opposite sides of said central portion and third and fourth lateral constriction portions adjacent said second rail-supporting portion and arranged on opposite sides of said central portion such that said first lateral constriction portion is opposite said third lateral constriction portion and said second lateral constriction portion is opposite said fourth lateral constriction portion.

7. The railroad tie of claim 1, wherein said body constitutes a double railroad tie having a width larger than a conventional railroad tie.

8. A railroad tie unit for a fixed track with an overlay of asphalt of the Getrac A3 construction, comprising:

first and second railroad ties separated from one another by a narrow gap to enable radial laying of rails, each of said first and second railroad ties comprising a body having first and second rail-supporting portions and a central portion between said first and second rail-supporting portions, said first and second rail-supporting portions having a width, said central portion having a recess on an underside;

a dowel stone arranged in said recess on the underside of said central portion of said body and adapted to engage a cavity pocket of the asphalt track, said body including lateral constrictions arranged to provide said central portion with a smaller width than the width of said first and second rail-supporting portions such that ends of the cavity pockets are uncovered.

9. The railroad tie unit of claim 8, wherein each of said first and second railroad ties further comprises an elastic ring bearing for holding said dowel stone in said recess on the underside of said central portion of said body.

10. The railroad tie unit of claim 8, wherein said central portion of said body includes a cavity on the underside having a low height and which is continuous over the width of said central portion.

11. The railroad tie unit of claim 8, wherein said central portion of said body includes a cavity on the underside which extends over a width of said central portion and over a greater length of said central portion than said dowel stone and prevents said central portion from being supported directly by the asphalt track.

12. The railroad tie unit of claim 8, further comprising a fabric substrate arranged only below said first and second rail-supporting portions of said first and second railroad ties and not below said central portion of said body of said first and second railroad ties.

13. The railroad tie unit of claim 8, wherein said lateral constrictions of said body of each of said first and second railroad ties include first and second lateral constriction portions adjacent said first rail-supporting portion and arranged on opposite sides of said central portion and third and fourth lateral constriction portions adjacent said second rail-supporting portion and arranged on opposite sides of said central portion such that said first lateral constriction portion is opposite said third lateral constriction portion and said second lateral constriction portion is opposite said fourth lateral constriction portion.

14. The railroad tie of claim 8, wherein said body of each of said first and second railroad ties constitutes a double railroad tie having a width larger than a conventional railroad tie.

15. A fixed track of the Getrac A3 construction, comprising:

a lower supporting layer;

an asphalt layer arranged above said lower supporting layer, said asphalt layer including a plurality of cavity pockets; and a plurality of railroad ties separated from one another by narrow gaps, each of said railroad ties comprising a body having first and second rail-supporting portions and a central portion between said first and second rail-supporting portions, said first and second rail-supporting portions having a width, said central portion having a recess on an underside;

a dowel stone arranged in said recess on the underside of said central portion of said body and engaging a respective one of said cavity pockets of said asphalt layer, said body including lateral constrictions arranged to provide said central portion with a smaller width than said first and second rail-supporting portions, said central portion having a smaller width than the width of said respective cavity pocket such that ends of said respective cavity pocket are uncovered.

16. The fixed track of claim 15, wherein said lateral constrictions of said body of each of said railroad ties include first and second lateral constriction portions adjacent said first rail-supporting portion and arranged on opposite sides of said central portion and third and fourth lateral constriction portions adjacent said second rail-supporting portion and arranged on opposite sides of said central portion such that said first lateral constriction portion is opposite said third lateral constriction portion and said second lateral constriction portion is opposite said fourth lateral constriction portion.

17. The fixed track of claim 15, wherein said central portion of said body of each of said railroad ties includes a cavity on the underside having a low height and which is continuous over the width of said central portion.

18. The fixed track of claim 15, wherein said central portion of said body of each of said railroad ties includes a cavity on the underside which extends over a width of said central portion and over a greater length of said central portion than said dowel stone such that said central portion is separated from and not supported directly by said asphalt layer.

19. The fixed track of claim 15, further comprising a fabric substrate arranged only below said first and second rail-supporting portions of each of said railroad ties and not below said central portion of said body of said railroad ties.

20. The fixed track of claim 15, wherein said body of each of said railroad ties constitutes a double railroad tie having a width larger than a conventional railroad tie.

* * * * *